US012607079B2

(12) United States Patent
Whitley et al.

(10) Patent No.: US 12,607,079 B2
(45) Date of Patent: Apr. 21, 2026

(54) TUBING HANGER FOR WELLSITE

(71) Applicant: Sonic Connectors Ltd., Midland, TX (US)

(72) Inventors: Brody Whitley, Midland, TX (US); Matt Duckworth, Odessa, TX (US)

(73) Assignee: Sonic Connectors Ltd., Odessa, TX (US)

( * ) Notice: Subject to any disclaimer, the term of this patent is extended or adjusted under 35 U.S.C. 154(b) by 0 days.

(21) Appl. No.: 18/732,811

(22) Filed: Jun. 4, 2024

(65) Prior Publication Data

US 2024/0318516 A1 Sep. 26, 2024

Related U.S. Application Data

(63) Continuation of application No. 17/476,922, filed on Sep. 16, 2021, now Pat. No. 12,000,224.

(60) Provisional application No. 63/079,768, filed on Sep. 17, 2020.

(51) Int. Cl.
*E21B 23/00* (2006.01)
*E21B 17/042* (2006.01)

(52) U.S. Cl.
CPC ..... *E21B 23/00* (2013.01); *E21B 17/042* (2013.01)

(58) Field of Classification Search
CPC ..... E21B 23/00; E21B 17/042; E21B 33/04
See application file for complete search history.

(56) References Cited

U.S. PATENT DOCUMENTS 1,114,808 A * 10/1914 Robinson ..... E21B 33/04 285/123.6
2,118,094 A * 5/1938 McDonough ..... E21B 34/02 285/123.3
2,127,312 A * 8/1938 Mervyn ..... E21B 33/04 166/84.1
2,153,852 A * 4/1939 Tschappat ..... E21B 33/047 285/123.3
2,337,221 A * 12/1943 Allen ..... E21B 33/04 285/123.8
2,766,829 A * 10/1956 Watts ..... E21B 33/04 987/234
3,248,132 A * 4/1966 Pierce, Jr. ..... E21B 33/04 166/89.1
3,437,149 A * 4/1969 Cugini ..... E21B 17/003 166/88.1
3,526,418 A * 9/1970 Barnett ..... E21B 33/04 285/123.12
4,154,302 A * 5/1979 Cugini ..... E21B 17/003 166/88.1
4,190,270 A * 2/1980 Vanderford ..... E21B 33/04 285/348
4,202,410 A * 5/1980 Quebe ..... E21B 33/04 166/88.4
4,289,199 A * 9/1981 McGee ..... E21B 33/0407 166/88.4
4,333,526 A * 6/1982 Watkins ..... E21B 34/02 166/72

(Continued)

*Primary Examiner* — Steven A MacDonald
(74) *Attorney, Agent, or Firm* — Baker & McKenzie LLP

(57) ABSTRACT

A tubing hanger is provided that includes a cylindrical body having a bore defined therethrough. Also, a connection member integrally is formed with the cylindrical body. The connection member includes threads for mating with a rotating flange of a production tree.

19 Claims, 4 Drawing Sheets

(56) References Cited

U.S. PATENT DOCUMENTS 4,449,583 A * 5/1984 Lawson ..... E21B 33/04 166/321
4,491,176 A * 1/1985 Reed ..... E21B 33/0407 166/88.4
4,600,054 A * 7/1986 Miller ..... E21B 33/0407 174/136
4,652,022 A * 3/1987 Nichols ..... E21B 33/04 285/393
4,708,201 A * 11/1987 Reed ..... H01R 13/523 439/191
4,938,289 A * 7/1990 Van Bilderbeek ..... E21B 33/04 166/368
RE34,071 E * 9/1992 Van Bilderbeek ..... E21B 33/04 166/368
5,148,865 A * 9/1992 Reed ..... E21B 33/0407 166/76.1
5,244,038 A * 9/1993 Watkins ..... E21B 33/04 166/120
5,456,321 A * 10/1995 Shiach ..... E21B 33/04 166/387
5,465,794 A * 11/1995 McConaughy ..... E21B 33/047 166/382
5,762,135 A * 6/1998 Moore ..... E21B 33/0407 174/76
5,795,169 A * 8/1998 Reed ..... E21B 33/0407 439/191
5,988,282 A * 11/1999 Jennings ..... E21B 33/04 166/88.4
6,047,776 A * 4/2000 Kiang ..... E21B 33/04 166/75.13
6,082,460 A * 7/2000 June ..... E21B 33/04 166/368
6,470,971 B1 * 10/2002 Bridges ..... E21B 34/02 166/88.4
8,813,837 B2 * 8/2014 Gette ..... E21B 33/04 166/84.1
2002/0162667 A1 * 11/2002 Ingram ..... E21B 33/0407 166/387
2003/0136556 A1 * 7/2003 Cornelssen ..... E21B 33/0407 166/89.1
2003/0196792 A1 * 10/2003 Riddell ..... E21B 33/0407 166/88.1
2004/0079532 A1 * 4/2004 Allen ..... E21B 33/04 166/89.3
2004/0231856 A1 * 11/2004 Dallas ..... E21B 33/04 166/75.13
2005/0056419 A1 * 3/2005 Hosie ..... E21B 33/0407 166/250.01
2005/0284640 A1 * 12/2005 Borak ..... E21B 33/04 166/75.13
2007/0267198 A1 * 11/2007 McGuire ..... E21B 33/068 166/379
2011/0174501 A1 * 7/2011 Struthers ..... E21B 17/025 166/77.2
2011/0180252 A1 * 7/2011 McGuire ..... E21B 33/068 166/73
2011/0203810 A1 * 8/2011 Nguyen ..... E21B 33/04 166/387
2011/0226490 A1 * 9/2011 Nguyen ..... E21B 33/035 166/382
2012/0024542 A1 * 2/2012 Keat ..... E21B 33/04 166/88.1
2012/0175108 A1 * 7/2012 Foubister ..... E21B 34/06 166/126
2012/0205123 A1 * 8/2012 Kennedy ..... E21B 33/04 166/208
2013/0075110 A1 * 3/2013 Shaw ..... E21B 23/04 166/373
2014/0216718 A1 * 8/2014 Bertrand ..... E21B 33/04 166/75.14
2014/0246197 A1 * 9/2014 Smith ..... E21B 43/162 166/305.1
2015/0107825 A1 * 4/2015 Miller ..... E21B 17/1078 166/250.1
2015/0114670 A1 * 4/2015 Turner ..... E21B 33/04 166/387
2015/0233204 A1 * 8/2015 Tarlton ..... E21B 33/0407 166/65.1
2018/0003002 A1 * 1/2018 Bowen, Jr. ..... E21B 34/02
2018/0148989 A1 * 5/2018 Ross ..... E21B 33/0407
2018/0347302 A1 * 12/2018 Smith ..... E21B 43/10
2019/0203554 A1 * 7/2019 Ross ..... E21B 17/023
2020/0063516 A1 * 2/2020 Nguyen ..... E21B 17/02
2020/0284118 A1 * 9/2020 Xiao ..... E21B 17/023
2021/0277750 A1 * 9/2021 Coffin ..... E21B 43/04
2022/0081981 A1 * 3/2022 Whitley ..... E21B 33/04
2022/0140525 A1 * 5/2022 Whitley ..... H01R 13/405 439/733.1
2022/0282589 A1 * 9/2022 Stoesser ..... E21B 33/04

* cited by examiner

TUBING HANGER FOR WELLSITE

CROSS REFERENCE TO RELATED APPLICATIONS

This application is a continuation application of and claims priority and benefit to U.S. patent application Ser. No. 17/476,922 filed on Sep. 16, 2021, which claims priority and benefit to U.S. provisional application No. 63/079,768 filed on Sep. 17, 2020, the contents of which are included herein in their entirety.

BACKGROUND

Hydrocarbon recovery operations often include drilling of a wellbore into the earth's surface to reach a hydrocarbon reservoir. The wellbore is typically then lined with casing and may be perforated adjacent to the reservoir formation. Production tubing may then be lowered into the wellbore to assist with recovery operations.

Tubing hangers are often used at the wellsite to suspend production tubing within a wellbore. Tubing hangers often comprise multiple components that are coupled together to complete the tubing hanger assembly. Further, it is often desired to have ports through the tubing hanger to accommodate electrical lines. Tubing hangers currently require the use of large adapters in order to connect the tubing hanger to a production tree above the tubing hanger. What is needed is an improved tubing hanger providing simplicity of design and ease of connection to a production tree.

BRIEF SUMMARY

According to one aspect of the subject matter described in this disclosure, a tubing hanger is provided. The tubing hanger includes a cylindrical body having a bore defined therethrough. Also, a connection member is integrally formed with the cylindrical body. The connection member includes threads for mating with a rotating flange of a production tree.

According to another aspect of the subject matter described in this disclosure, a method for implementing a tubing hanger is provided. The method includes providing a cylindrical body having a bore defined therethrough. Moreover, the method includes integrally forming a connection member with the cylindrical body. The connection member includes threads for mating with a rotating flange of a production tree.

According to another aspect of the subject matter described in this disclosure, a tubing hanger is provided. The tubing hanger includes a cylindrical body having a bore defined therethrough. At least one port is arranged circumferentially along one portion of the cylindrical body such that the at least one port does not extend around the bore. A connection member is integrally formed with the cylindrical body. The connection member is directly mated to a rotating flange of a production tree.

Additional features and advantages of the present disclosure are described in, and will be apparent from, the detailed description of this disclosure.

BRIEF DESCRIPTION OF THE DRAWINGS

The disclosure is illustrated by way of example, and not by way of limitation, in the figures of the accompanying drawings in which like reference numerals are used to refer to similar elements. It is emphasized that various features may not be drawn to scale and the dimensions of various features may be arbitrarily increased or reduced for clarity of discussion.

DETAILED DESCRIPTION

The figures and descriptions provided herein may have been simplified to illustrate aspects that are relevant for a clear understanding of the herein described devices, systems, and methods, while eliminating, for the purpose of clarity, other aspects that may be found in typical similar devices, systems, and methods. Those of ordinary skill may recognize that other elements and/or operations may be desirable and/or necessary to implement the devices, systems, and methods described herein. But because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Figure 1:
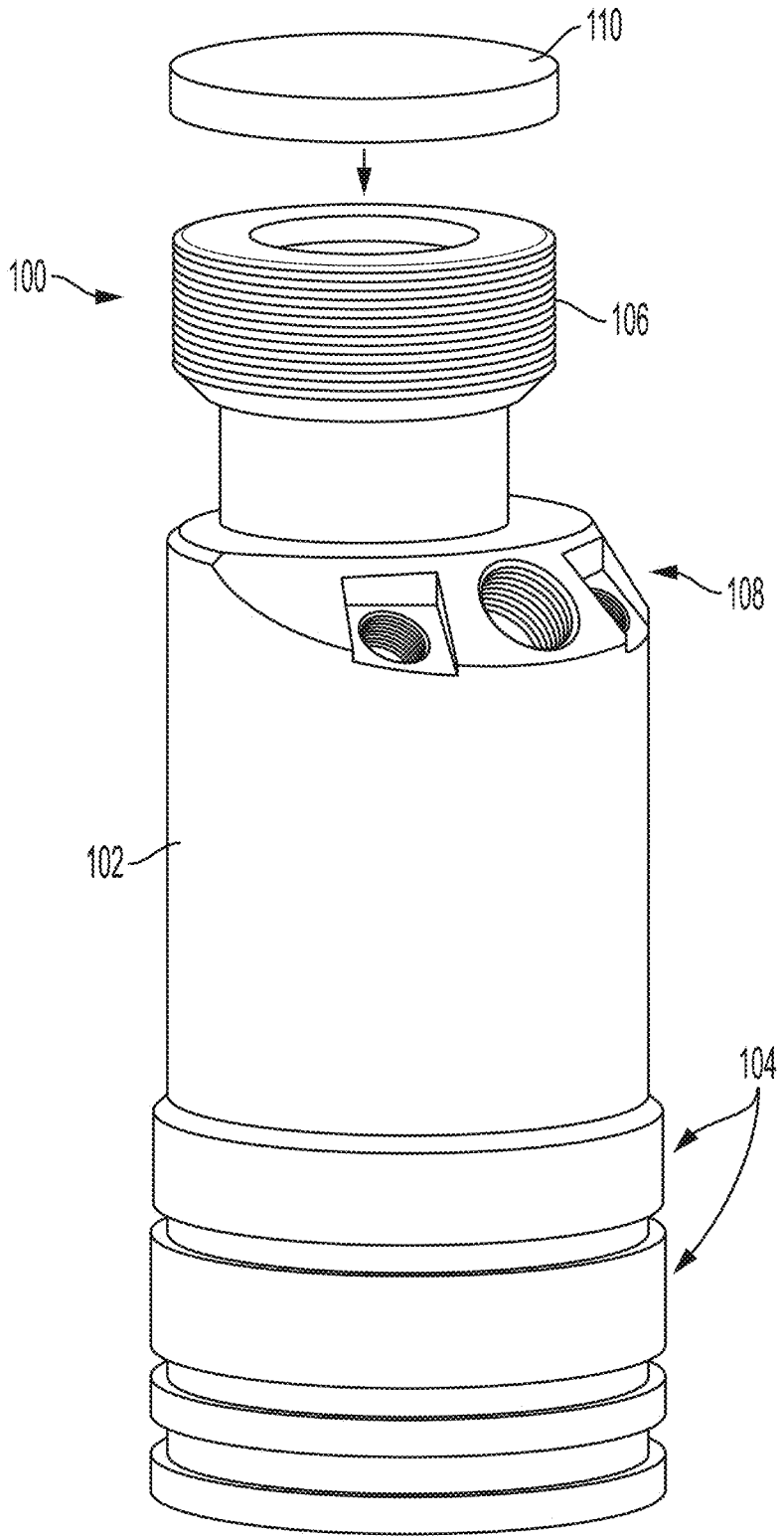
FIG. 1 is a schematic diagram illustrating the improved tubing hanger, in accordance with some embodiments.

The present disclosure relates to an improved tubing hanger for use at a wellsite. FIG. 1 is a schematic diagram illustrating the improved tubing hanger 100, in accordance with some embodiments. The tubing hanger 100 includes a cylindrical body 102 having grooves 104 at a lower end for accommodating O-rings for sealing against an inner diameter of a tubing head. The tubing hanger 100 further includes an upper connection member 106 integrally formed with the cylindrical body. The connection member 106 includes threads for sealing to a rotating flange of production tree 110 (shown schematically in FIG. 1). The production tree 110 may include an assembly of valves, spools, pressure gauges, chokes, or the like fitted to connection member 106 to direct and control the flow of formation fluids from a well. In this manner, there is no need for a separate adapter to connect the tubing hanger 100 to the production tree 110 and the arrangement is thus simplified.

The tubing hanger may have one or more ports 108 defined therethrough. In a preferred embodiment, the tubing hanger 100 includes three ports 108 for accommodating a chemical treatment line, an electrical feed line and a bottom hole pressure gauge line, respectively.

Figure 2:
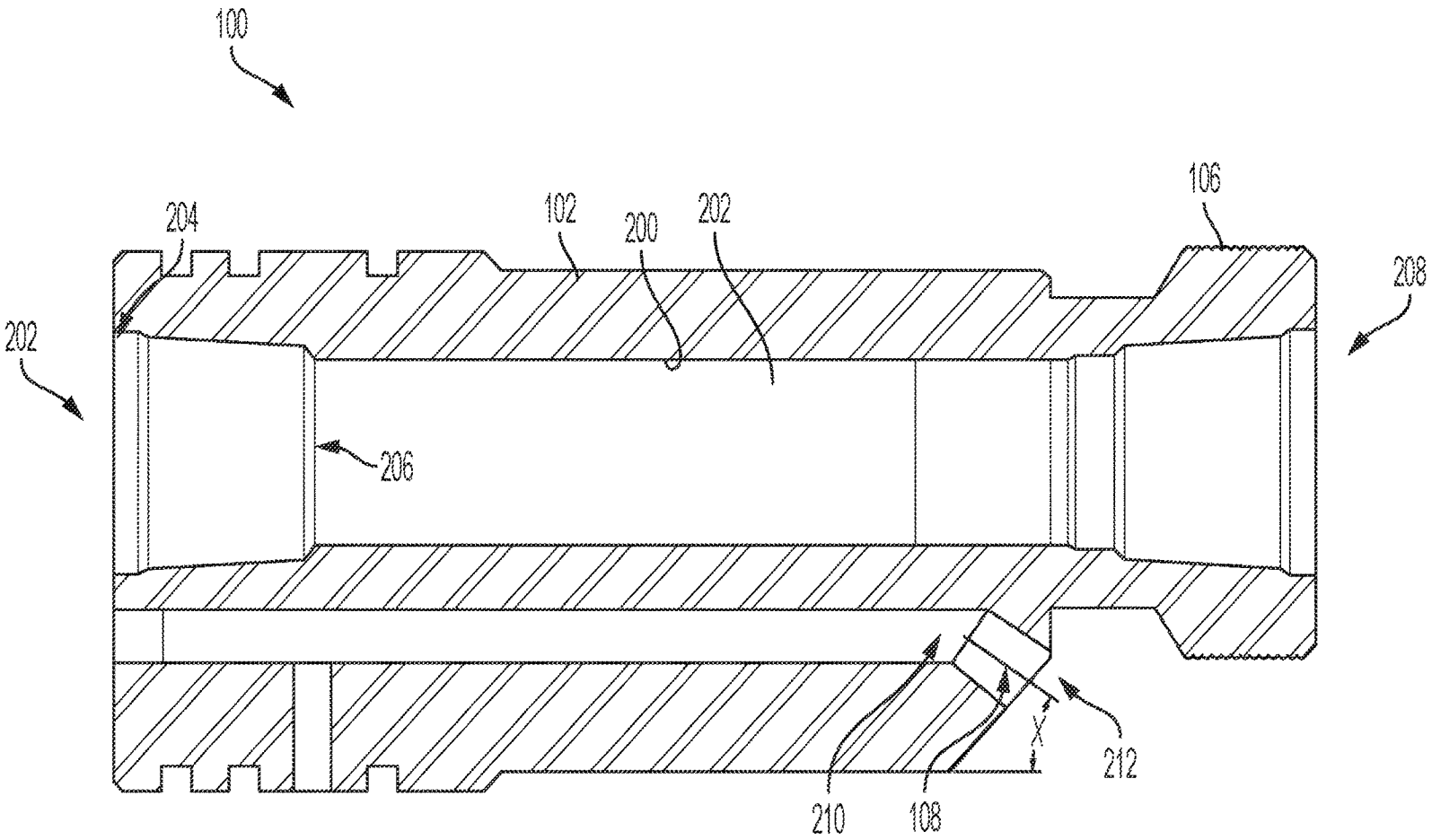
FIG. 2 is a schematic diagram illustrating a cross sectional view of the improved tubing hanger of FIG. 1, in accordance with some embodiments.

FIG. 2 is a schematic diagram illustrating a cross sectional view of the improved tubing hanger 100 of FIG. 1, in accordance with some embodiments. The tubing hanger 100 according to the present disclosure includes a bore 200 defining an inner diameter. The bore 200 of the tubing hanger 100 has an initial diameter 204 at the distal bottom end 202 of the hanger 100, which then decreases until it reaches a second diameter 206, which is substantially constant through the cylindrical body 102. The bore 200 continues through the connection member 106 and gradually increases in diameter to a proximal top end 208 of the hanger 100.

Also as shown above, the ports 108 are substantially constant in diameter 210 through the cylindrical body 102, but are angled outward from cylindrically body 102 at a proximal end 212 of the cylindrical body 200. In other words, the centerline of the exits of the ports 108 is angled relative to the centerline of the bore 200. In this manner, the chemical treatment line, electrical feed line and bottom hole pressure gauge line may be angled away from the cylindrical body 200 and connection member. This arrangement facilitates connection of the tubing hanger 100 to the production tree.

Figure 3B:
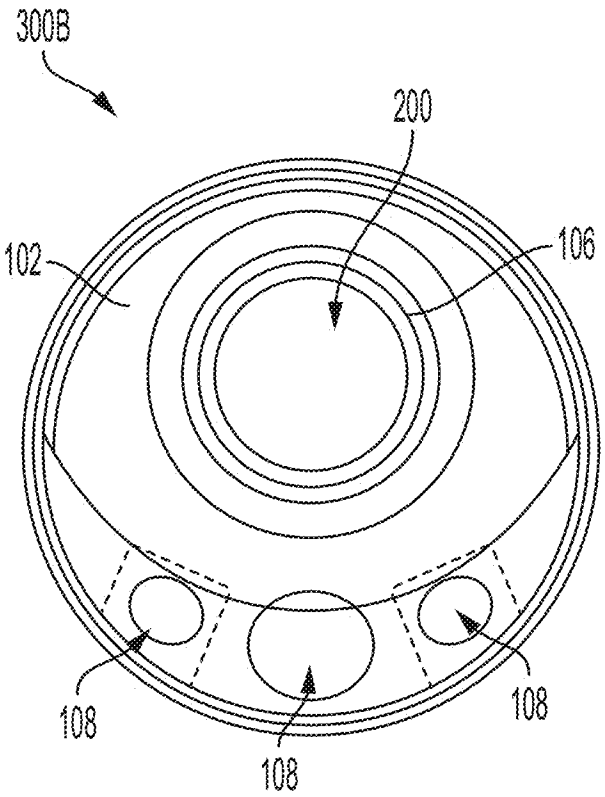
FIG. 3B is a schematic diagram illustrating a top view of the tubing hanger of FIG. 1 respectively, in accordance with some embodiments.
Figure 3A:
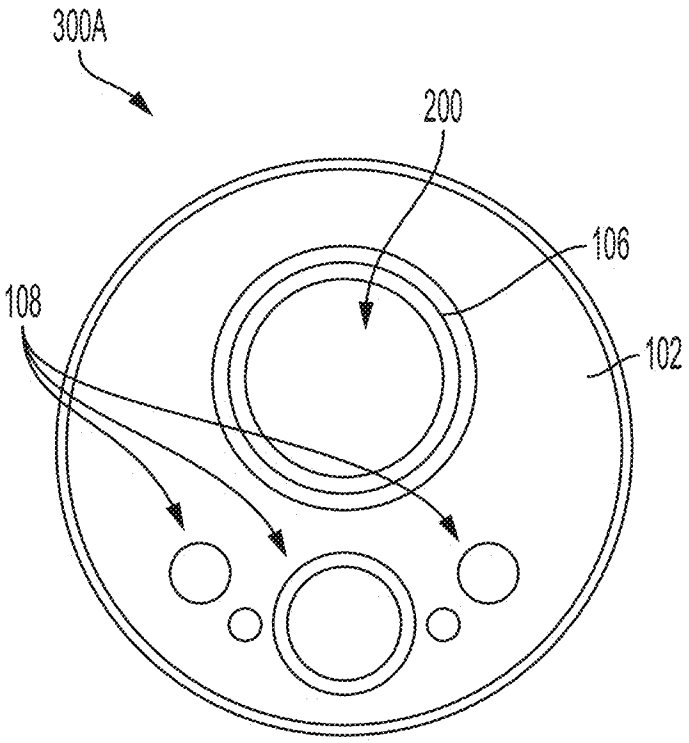
FIG. 3A is a schematic diagram illustrating a bottom view of the tubing hanger of FIG. 1 respectively, in accordance with some embodiments.

FIGS. 3A and 3B are schematic diagrams illustrating bottom and top views of the tubing hanger 100 of FIG. 1, respectively, in accordance with some embodiments. In particular, FIG. 3A illustrates the top view 300A and FIG. 3B illustrates the bottom view 300B of the arrangement of the bore 200 and ports 108.

Figure 4:
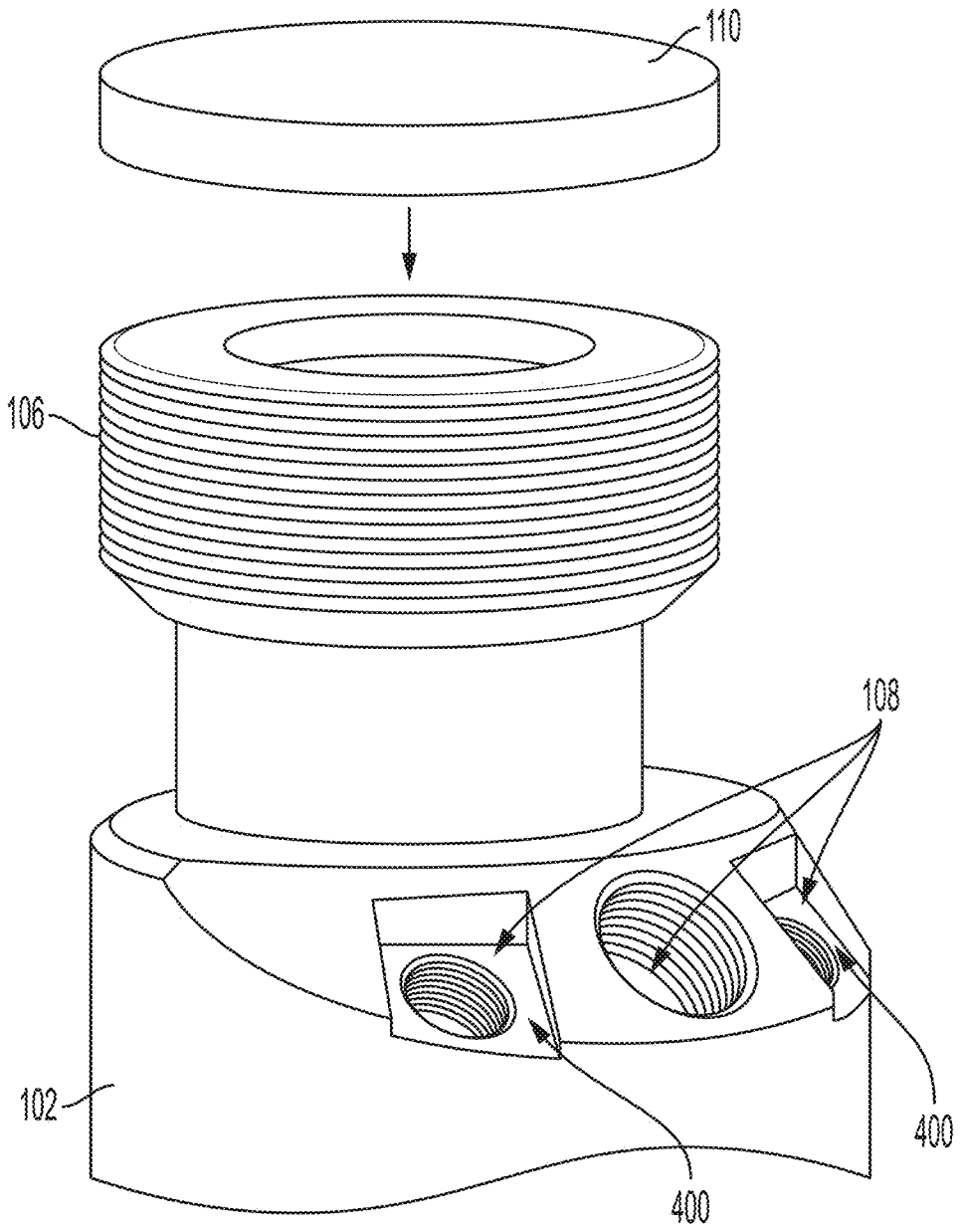
FIG. 4 is a schematic diagram illustrating a detailed view of the ports of the improved tubing hanger of FIG. 1, in accordance with some embodiments.

In one embodiment, the ports 108 are defined through a portion of the cylindrical body 102 offset from the bore 200. The ports 108 may be arranged circumferentially along one portion of the cylindrical body 102 such that they do not extend around the bore 200. As shown in the above figures, the bore 200 may be offset from the center of the cylindrical body 102. Further, and is best seen in FIG. 4, one or more of the ports 400 may have a recessed configuration relative to the cylindrical body 102. Moreover, FIG. 4 shows a schematic depiction of the production tree 110 being fitted to connection member 106.

Further, the ports 108, as shown in FIGS. 1 and 4, may be threaded to accommodate connection to the respective chemical treatment line, electrical feed line and bottom hole pressure gauge line.

While not shown, the tubing hanger 100 may also be used with a sealing flange that seals the outer diameter of the tubing hanger. In some embodiments, the sealing flange includes O-rings that provide the seal on the outer diameter of the tubing hanger. The sealing flange may be pressure fit onto the tubing hanger after the tubing hanger is landed on the tubing head.

The tubing hanger according to the present disclosure has certain advantages over prior art tubing hangers. As is appreciated in the art, tubing hangers are traditionally used with tubing adapters in order to provide a connection between the tubing hanger and the production tree. In the hydrocarbon recovery industry, the production tree or "Christmas" tree is typically an assembly of valves, casing spools, and fittings used to regulate the flow of pipes in an oil well, gas well, water injection well, water disposal well, gas injection well, condensate well and other types of wells. The tubing hanger of the present disclosure eliminates the need for a tubing adapter as the connection member is able to receive a rotating flange of the production tree directly onto the connection member, thus facilitating coupling of the production tree to the tubing hanger without the need for a tubing adapter.

Reference in the specification to "one implementation" or "an implementation" means that a particular feature, structure, or characteristic described in connection with the implementation is included in at least one implementation of the disclosure. The appearances of the phrase "in one implementation," "in some implementations," "in one instance," "in some instances," "in one case," "in some cases," "in one embodiment," or "in some embodiments" in various places in the specification are not necessarily all referring to the same implementation or embodiment.

Finally, the above descriptions of the implementations of the present disclosure have been presented for the purposes of illustration and description. It is not intended to be exhaustive or to limit the present disclosure to the precise form disclosed. Many modifications and variations are possible in light of the above teaching. It is intended that the scope of the present disclosure be limited not by this detailed description, but rather by the claims of this application. As will be understood by those familiar with the art, the present disclosure may be embodied in other specific forms without departing from the spirit or essential characteristics thereof. Accordingly, the present disclosure is intended to be illustrative, but not limiting, of the scope of the present disclosure, which is set forth in the following claims.

What is claimed is:

1. A tubing hanger, comprising:

a cylindrical body having a bore defined therethrough;

a connection member integrally formed and directly connected with the cylindrical body, the connection member-including threads circumferentially about the bore, for mating with a rotating flange of a production tree, wherein the connection member is configured to directly mate with a rotating flange of a production tree;

the cylindrical body having a bottom surface, opposite the connection member, absent any grooves; and a port defined through the cylindrical body, wherein the port comprises a through bore with a first port opening and a second port opening, and runs parallel to and is offset from the bore of the cylindrical body, and a pressure test port extending laterally and perpendicular from the port and intersecting the port to form a third port opening.

2. The tubing hanger of claim 1, wherein the cylindrical body comprises a plurality of grooves at one end for accommodating at least one O-ring for sealing against an inner diameter of a tubing head.

3. The tubing hanger of claim 1 further comprising a plurality of ports formed on the cylindrical body.

4. The tubing hanger of claim 3, wherein the ports are configured to accommodate a chemical treatment line, an electrical feed line and a bottom hole pressure gauge line, respectively.

5. The tubing hanger of claim 1, wherein the bore comprises an initial diameter at the distal end of the cylindrical body, which then decreases until it reaches a second diameter configured to be substantially constant through the cylindrical body.

6. The tubing hanger of claim 5, wherein the bore passes through the connection member and gradually increases in diameter to a proximal end of the tubing hanger.

7. The tubing hanger of claim 1, wherein the port is substantially constant in diameter through the cylindrical body.

8. The tubing hanger of claim 1, wherein the port is configured to be angled outward from the cylindrically body at a proximal end of the cylindrical body.

9. A method for implementing a tubing hanger, comprising:

providing a cylindrical body having a bore defined therethrough;

integrally forming and directly connecting a connection member with the cylindrical body, the connection member including threads circumferentially about the bore, for mating with a rotating flange of a production tree, the cylindrical body having a bottom surface, opposite the connection member, absent any grooves;

wherein the connection member is configured to directly mate with a rotating flange of a production tree;

forming a port defined through the cylindrical body, wherein the port comprises a through bore having a first port opening and a second port opening, and runs parallel to and is offset from the bore of the cylindrical body; and forming a pressure test port fluidly coupled to the port and extending laterally and perpendicular from the port to form a third port opening.

10. The method of claim 9, wherein providing the cylindrical body comprises forming a plurality of grooves at one end for accommodating at least one O-ring for sealing against an inner diameter of a tubing head.

11. The method of claim 9, wherein the port is configured to accommodate a chemical treatment line and an electrical feed line.

12. The method of claim 9, wherein providing the cylindrical body comprises constructing the bore to have an initial diameter at the distal end of the cylindrical body, which then decreases until it reaches a second diameter configured to be substantially constant through the cylindrical body.

13. The method of claim 12, wherein the bore passes through the connection member and gradually increases in diameter to a proximal end of the tubing hanger.

14. The method of claim 9, wherein forming the port comprises constructing the port to be substantially constant in diameter through the cylindrical body.

15. The method of claim 9 wherein forming the port comprises positioning the port to be angled outward from the cylindrically body at a proximal end of the cylindrical body.

16. A tubing hanger, comprising:

a cylindrical body having a bore defined therethrough;

a port arranged circumferentially through one portion of the cylindrical body and having a first port opening and a second port opening, wherein the port runs parallel to and is offset from the bore of the cylindrical body, and a pressure test port fluidly coupled to the port and extending laterally and perpendicular from the port to form a third port opening; and a connection member integrally formed having threads circumferentially about the bore, and directly connected with the cylindrical body, the cylindrical body having a bottom surface, opposite the connection member, absent any grooves;

wherein the connection member is directly mated to a rotating flange of a production tree, and wherein the connection member is configured to directly mate with a rotating flange of a production tree.

17. The tubing hanger of claim 16, wherein the bore is offset from a center of the cylindrical body.

18. The tubing hanger of claim 16, wherein the port further comprises a recessed configuration relative to the cylindrical body.

19. The tubing hanger of claim 16, wherein the port is threaded to accommodate connection to a chemical treatment line and an electrical feed line.

* * * * *